US007164078B2

(12) United States Patent
Grögl et al.

(10) Patent No.: US 7,164,078 B2
(45) Date of Patent: Jan. 16, 2007

(54) ABRASION-RESISTANT JACKET

(75) Inventors: Ferdinand Grögl, Nürnberg (DE); Alfred Mehl, Georgensgmünd (DE)

(73) Assignee: Nexans, Paris (FR)

( * ) Notice: Subject to any disclaimer, the term of this patent is extended or adjusted under 35 U.S.C. 154(b) by 0 days.

(21) Appl. No.: 10/800,674

(22) Filed: Mar. 16, 2004

(65) Prior Publication Data

US 2005/0150679 A1 Jul. 14, 2005

(30) Foreign Application Priority Data

Mar. 17, 2003 (EP) ..... 03290667

(51) Int. Cl.
*H01B 7/34* (2006.01)
*H01B 7/18* (2006.01)

(52) U.S. Cl. ..... 174/36; 174/102 R

(58) Field of Classification Search ..... 174/36, 174/102 R, 110 R, 112, 118, 119 C, 120 AR, 174/120 SR See application file for complete search history.

(56) References Cited

U.S. PATENT DOCUMENTS

| | | | | | |
|---|---|---|---|---|---|
| 1,698,704 | A | * | 1/1929 | Middleton et al. | 174/103 |
| 2,930,837 | A | * | 3/1960 | Thompson | 174/115 |
| 3,429,984 | A | * | 2/1969 | Alexander | 174/115 |
| 3,711,621 | A | * | 1/1973 | Jachimowicz | 174/23 R |
| 4,343,333 | A | * | 8/1982 | Keister | 138/125 |
| 4,360,704 | A | * | 11/1982 | Madry | 174/36 |
| 4,477,693 | A | * | 10/1984 | Krabec et al. | 174/36 |
| 4,654,476 | A | * | 3/1987 | Barnicol-Ottler et al. | 174/116 |
| 4,675,475 | A | * | 6/1987 | Bortner et al. | 174/113 R |
| 5,087,513 | A | * | 2/1992 | Kim | 442/118 |
| 5,293,442 | A | * | 3/1994 | Sayegh | 385/102 |
| 5,300,337 | A | * | 4/1994 | Andrieu et al. | 428/36.1 |
| 5,313,020 | A | * | 5/1994 | Sackett | 174/113 C |
| 5,557,698 | A | * | 9/1996 | Gareis et al. | 385/101 |
| 5,706,382 | A | * | 1/1998 | Smith | 385/102 |
| 5,920,671 | A | * | 7/1999 | Smith | 385/102 |
| 6,233,384 | B1 | * | 5/2001 | Sowell et al. | 385/107 |
| 2004/0076824 | A1 | * | 4/2004 | Urabe et al. | 428/375 |

FOREIGN PATENT DOCUMENTS

| | | | |
|---|---|---|---|
| DE | 222542 | A | 8/1906 |
| DE | 195 25 687 | A1 | 1/1997 |
| DE | 201 00 911 | U1 | 5/2001 |
| DE | 201 02 848 | U1 | 10/2001 |
| EP | 0 790 624 | A2 * | 2/1997 |
| EP | 0 790 624 | A2 | 8/1997 |

* cited by examiner

*Primary Examiner*—William H. Mayo, III
(74) *Attorney, Agent, or Firm*—Sughrue Mion, PLLC

(57) ABSTRACT

An abrasion-resistant jacket for a flexible cable with a cable core and a jacket made of an abrasion-resistant thermoplastic material surrounding the cable core, particularly for a drag chain cable or a robot cable. The jacket includes an inner extruded plastic layer (2) and an outer jacket layer (4). Between the inner plastic layer (2) and the outer jacket layer (4) is a layer (3) of monofilaments made of a chemically and thermally stable material with a visual coverage of 40 to 70%. The outer jacket layer (4) is applied by pressure extrusion, such that the spaces in the layer (3) are almost filled by the material of the outer jacket layer, and the layer (3) adheres to the inner sheath layer (2).

7 Claims, 1 Drawing Sheet

ABRASION-RESISTANT JACKET

This application is based on and claims the benefit of European Patent Application No. 03290667.9 filed Mar. 17, 2003, which is incorporated by reference herein.

BACKGROUND OF THE INVENTION

The invention relates to an abrasion-resistant jacket for a flexible cable with a cable core and a jacket made of an abrasion-resistant thermoplastic material surrounding the cable core, particularly for a drag chain cable or a robot cable.

To control modern robotic and handling systems, lines with a high degree of flexibility and fatigue strength under reversed bending stress are required. Such lines are in continuous motion during operation. They must withstand torsion values of ±440° in continuous operation.

The October 2000 issue, volume 82 of the periodical "Elektrotechnik" describes a highly flexible cable for use in modem robots in which several individual cables are accommodated in a hybrid line. The individual cables are unit stranded around a conductive core. To minimize friction of the individual structural elements, these elements have low-friction insulating surfaces and extensive wrapping. Preferred insulation materials are those based on polyurethane, which are distinguished by high abrasion resistance and resistance to hydraulic fluid and mineral oil. Thermoplastic elastomers are used for the jacket, so that the jacket is resistant to notching and abrasion.

In addition to this material, a halogen-free and self-extinguishing polyurethane-based jacket material has become known in the art, which is being used with great success for welding lines because of its high flexibility and extreme protection against weld spatters.

As a result of the significant mechanical loads due to bending, torsion and especially friction which occurs frequently because of tight spaces, abrasion of the jacket is so severe that the cables have to be replaced after a short time. Downtimes are expensive, however, and the operators of assembly lines equipped with robots are very reluctant to accept them.

SUMMARY OF THE INVENTION

Thus, the object of the present invention is to improve the abrasion resistance of the outer jacket, without increasing the jacket weight, and thereby increase the useful life of such cables.

This object is attained by an abrasion resistant jacket wherein the jacket is made of an inner extruded plastic layer (2) and an outer jacket layer (4), between the inner plastic layer (2) and the outer jacket layer (4) a layer (3) made of monofilaments of a chemically and thermally stable material is provided with a visual coverage of 40 to 70%, and the outer jacket layer (4) is applied by pressure extrusion, such that the spaces in the layer (3) are nearly filled by the material of the outer jacket layer, and the layer (3) adheres to the inner sheath layer (2).

The essential advantage of the invention is that jacket abrasion, as it occurs in cable jackets of the prior art, is either stopped or at least strongly reduced by the additional layer. The oil or media resistance of the entire line or the entire cable is improved because the monofilaments used are highly resistant against oils and other media. The flame resistance of the line or the jacket can be improved by the use of filament materials that have been made flame resistant. A further essential advantage is that the solution according to the invention makes it possible to reduce the wall thickness. This is advantageous with respect to the outside diameter and the flexibility of the cable or line. By improving the mechanical properties of the line or cable, it is possible under some circumstances to dispense with the costly grease that operators often use.

BRIEF DESCRIPTION OF THE DRAWINGS

The invention will now be described in greater detail, by way of example, with reference the drawings, wherein.

DETAILED DESCRIPTION OF THE INVENTION

In the figures, 1 designates the cable core, which can include a plurality of electric wires with different cross sections. The cable core can also include one or more—electrical or optical—data lines.

The cable core 1 is surrounded by a plastic layer 2, which can be an inner sheath or a plastic layer enclosing the cable core 1.

Figure 1:
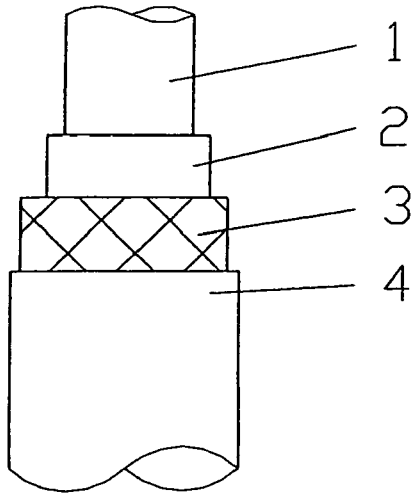
FIG. 1 schematically illustrates an abrasion resistant jacket according to the invention.

In the embodiment shown in FIG. 1, a braid 3 made of monofilaments is applied to the plastic layer 2. The braid 3 has a visual coverage of between 40 and 70%. The individual monofilaments are preferably made of polyethersulfone or polyamide. As an alternative to these materials, monofilaments made of polyterephthalate, polyurea, polycarbonate, polyacrylonitrile, polyvinylchloride, polyethylene and polypropylene may be used. The materials are preferably made flame resistant.

The monofilaments preferably have a diameter of 0.15 to 0.25 mm.

Instead of braiding, it is also possible to use stranding of the monofilaments. This solution is particularly advantageous in lines subject to strong torsional loading.

A plastic jacket 4 is applied to the layer 3 by means of pressure extrusion, i.e., the plastic material of the jacket 4 is pressed into the free spaces of layer 3, such that a bond results between the layers 2, 3 and 4. The jacket 4 is preferably made of polyurethane or a thermoplastic elastomer (TPE-O), e.g., Santoprene.

Figure 2:
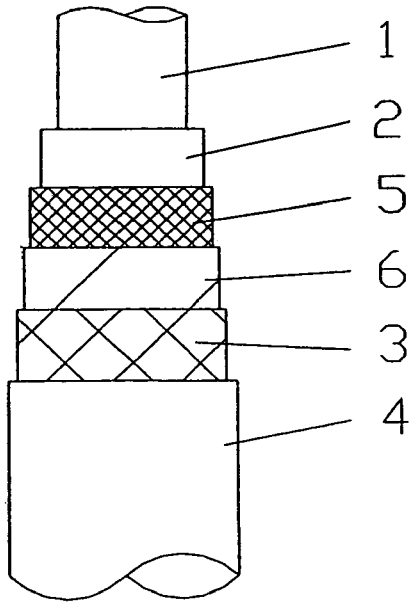
FIG. 2 schematically illustrates and alternative embodiment of the invention.

In the embodiment of the invention shown in FIG. 2, a metal braid 5 is further provided between the inner layer 2 and the layer 3. This metal braid acts as an electric shield for the line or the cable. A copper braid shield is preferred.

Between the shielding braid 5 and the layer 3, a plastic foil 6, e.g., made of polyurethane or polyethylene terephthalate is provided.

What is claimed is:

1. A flexible cable with an abrasion resistant sheath made of thermoplastic material, particularly a drag chain cable or a robot cable, wherein the sheath comprises:

an inner extruded plastic layer (2);

a metal braided shield (5);

a separation layer of a non-woven material or a plastic foil (6) surrounding said metal braided shield;

a braiding (3) surrounding said separation layer with a visual coverage of 40% to 70% , the braiding (3)

consisting of monofilaments, said monofilaments comprising a plurality of filaments of a material which is chemically and thermally stable; and an outer plastic layer (4) over said braiding and applied by pressure extrusion, such that the spaces in the braiding (3) are nearly filled by the material of the outer plastic layer (4), wherein the diameter of said monofilaments is between 0.15 and 0.25 mm, and the monofilaments contain a flame-proofing agent.

2. A flexible cable as claimed in claim 1, wherein said monofilaments are made of polyamide, preferably polyamide 6.

3. A flexible cable as claimed in claim 1, wherein the monofilaments made of polyethersulfone.

4. A flexible cable as claimed in claim 1, wherein the non-woven material or the plastic foil (6) is coated with a powder that swells in the presence of moisture.

5. A flexible cable as claimed in claim 1, said cable including a plurality of wires embedded in an inner sheath.

6. A flexible cable as claimed claim 1, wherein said visual coverage is between 50% and 65%.

7. A flexible cable as claimed in claim 1, wherein the jacket is made of at least one material selected from the group consisting of polyurethane, polyvinylchloride or a thermoplastic elastomer.

* * * * *